US005887917A

United States Patent [19]

Luciana

[11] Patent Number: 5,887,917

[45] Date of Patent: Mar. 30, 1999

[54] MAGNETIC DOORSTOP

[76] Inventor: Wilson C. Luciana, 112 Park Ave., Somerdale, N.J. 08083

[21] Appl. No.: 72,902

[22] Filed: May 4, 1998

[51] Int. Cl.[6] ..... E05C 17/56

[52] U.S. Cl. ..... 292/251.5; 292/DIG. 15; 335/285; 335/286; 335/302; 335/306; 16/82

[58] Field of Search ..... 335/285, 286, 335/302, 306; 292/251.5, DIG. 15; 16/82

[56] References Cited

U.S. PATENT DOCUMENTS

| | | | |
|---|---|---|---|
| 2,815,236 | 12/1957 | Lowinski . | |
| 3,100,664 | 8/1963 | Duval . | |
| 3,258,285 | 6/1966 | Smith . | |
| 3,734,553 | 5/1973 | Sugasawara | 292/251.5 |
| 4,505,502 | 3/1985 | Tomita | 292/251.5 |
| 4,669,766 | 6/1987 | Hanchett, Jr. et al. | 292/251.5 |
| 4,852,919 | 8/1989 | Nimee et al. | 292/251.5 |

*Primary Examiner*—Michael L. Gellner
*Assistant Examiner*—Tuyen T. Nguyen

[57] ABSTRACT

A magnetic doorstop including a first section consisting of a magnet secured with a retaining shim mounted on an elongated adjustment screw and a second section consisting of a magnet secured with a retaining shim mounted on an attachment screw. The first section is attached to an interior wall of a dwelling and the second section is attached to the interior door. When the door is opened, the first and second sections contact magnetically securing the door in an open position.

14 Claims, 4 Drawing Sheets

MAGNETIC DOORSTOP

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to equipment associated with the interior door of a dwelling. When an interior door is placed in the open position, the door may swing partially or completely closed. This problem may be attributed to door alignment, installation problems, or dwelling settlement.

One difficulty with such a door may be the extent of repair, expense and inconvenience to correct this problem. Prior devices for securing such a door have had disadvantages. The use of a standard doorstop placed infront of the door must be removed and replaced each time the door is used.

BRIEF SUMMARY OF THE INVENTION

The invention is directed to conveniently solving the problem of an interior door that does not stay in position when opened, but swings partially or,completely closed. The object of the present invention is to pro-ride an attachable device for securing an interior door in the open position.

The magnetic doorstop consists of a first magnet mounted on an elongated adjustment screw secured with a retaining shim, which is attached to the interior wall of a dwelling. A second magnet mounted on an attachment screw secured with a retaining shim is attached to the interior door. The first section and the second section are aligned with the unlike magnetic poles facing one another. When the interior door is fully opened, the first and second sections of the magnetic doorstop contact magnetically sectoring the interior door in the open position.

DETAILED DESCRIPTION OF THE INVENTION

Figure 1:
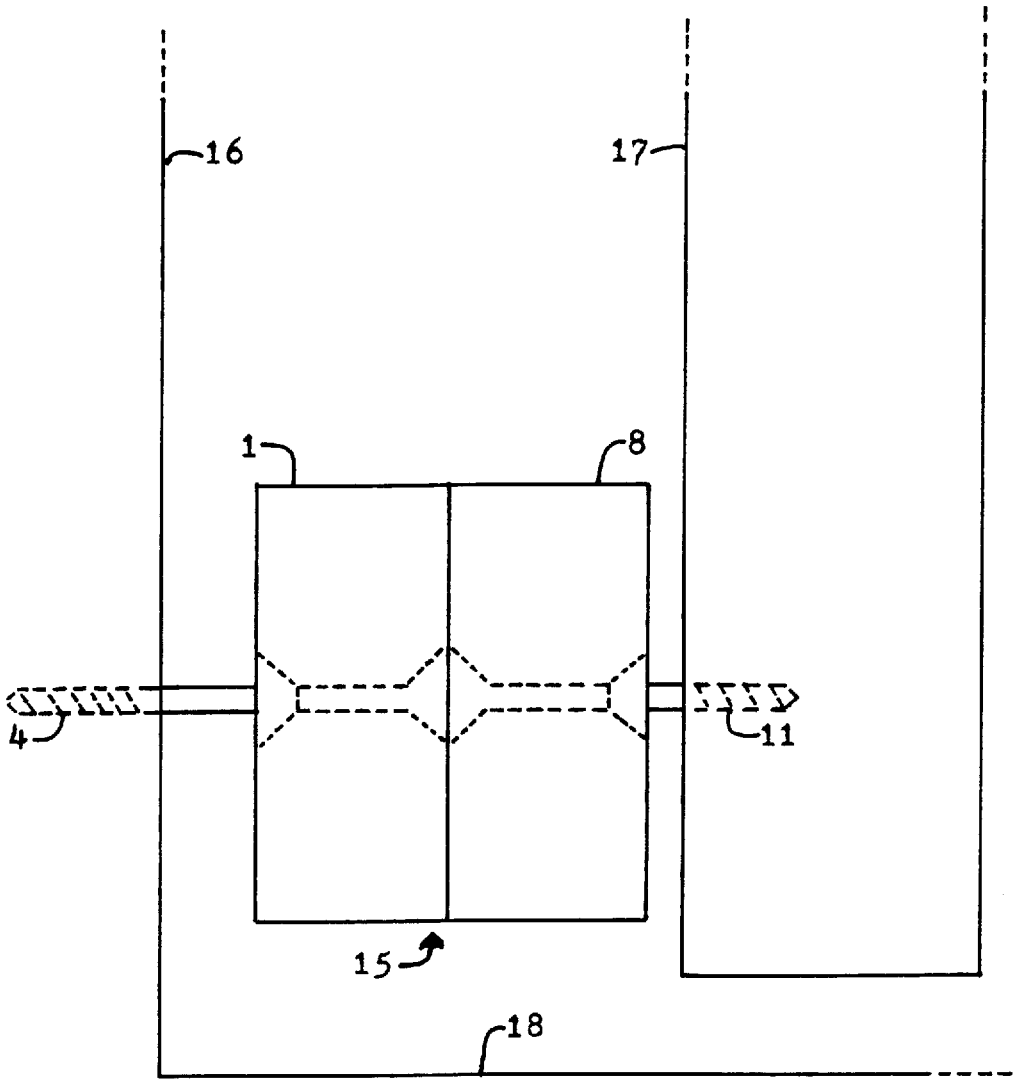
FIG. 1 is a plan view of the magnetic doorstop of the invention used to secure an interior door of a dwelling in the open position.
Figure 2:
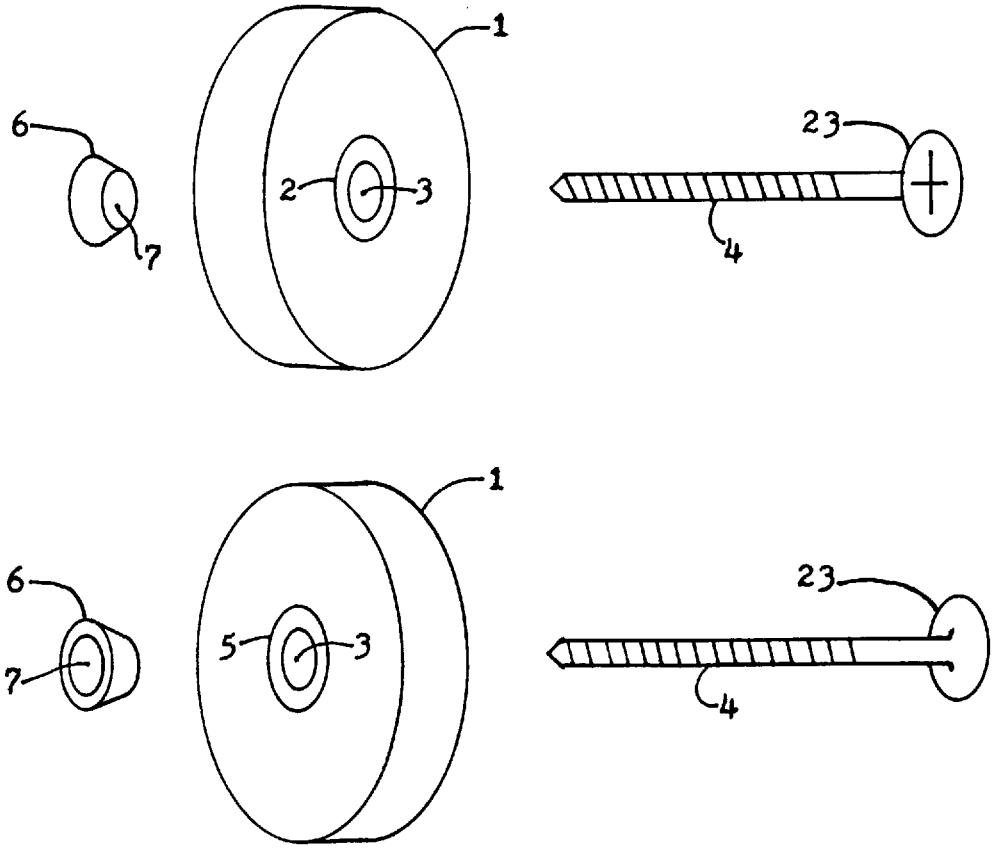
FIG. 2 is an exploded perspective view of the wall section members (opposite views).
Figure 3:
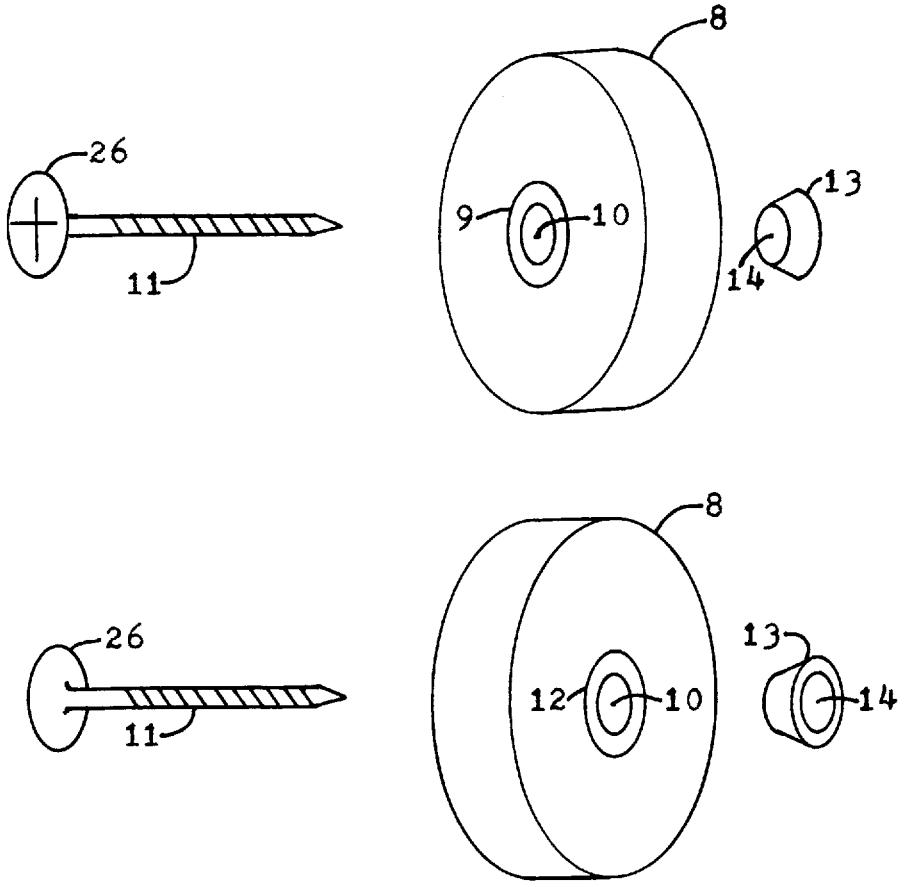
FIG. 3 is an exploded perspective view of the door section members (opposite views).

Referring to FIG. 1, a magnetic doorstop indicated generally at 15 is used to magnetically secure interior door 17 in an open position adjacent interior wall 16 in proximity to dwelling floor 18. Referring to FIG. 2, magnet 1 is adapted with circumferential recess 2, opposite recess 5, and centrally located aperture 3. Retaining shim 6 is a cylindrical cone shaped wedge adapted with aperture 7. Screw 4 is an elongated adjustment member having slotted screwhead 23. Referring to FIG. 3, magnet 8 is adapted with circumferential recess 9, opposite recess 12, and centrally located aperture 10. Retaining shim 13 is a cylindrical cone shaped wedge adapted with aperture 14. Screw 11 is an attachment member having slotted screwhead 26.

Figure 4:
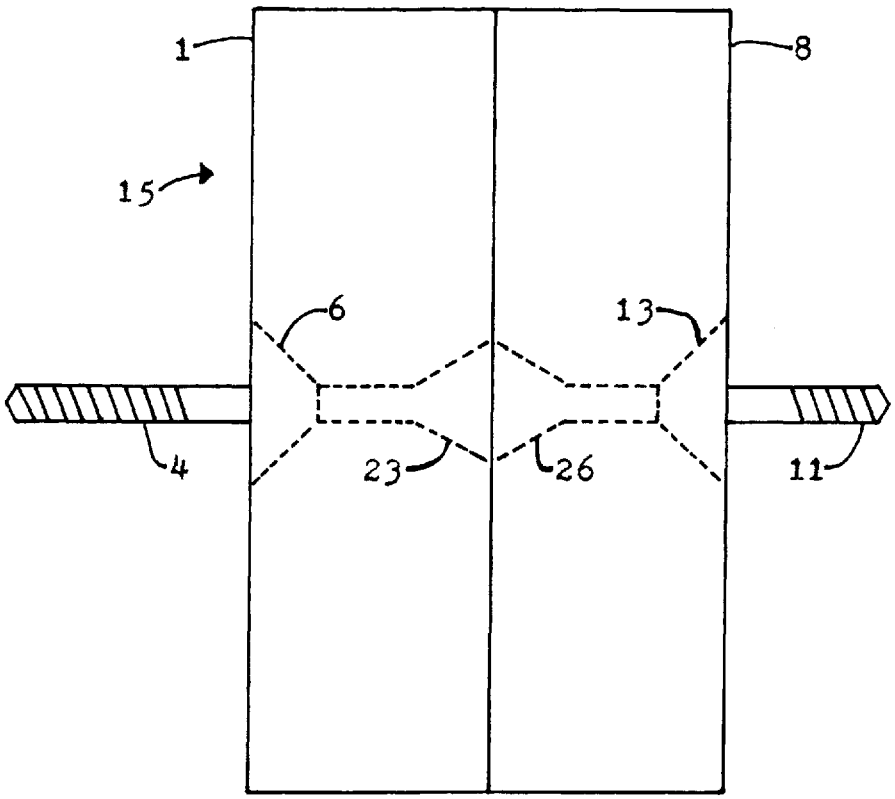
FIG. 4 id an enlarged plan view of the magnetic door stop of FIG. 1.

Referring to FIG. 4, magnet 1 is mounted circumferentially with aperture 3 on elongated adjustment screw 4 having screw 4 positioned within aperture 3 and slotted screwhead 23 within recess 2. Retaining shim 6 is mounted circumferentially with aperture 7 on screw 4 positioned within recess 5. Magnet 8 is mounted circumferentially with aperture 10 on attachment screw 11 having screw 11 positioned within aperture 10 and slotted screwhead 26 within recess 9. Retaining shim 13 is mounted circumferentially with aperture 14 on screw 11 positioned within recess 12. The unlike magnetic polarity of magnet 1 and magnet 8 are aligned facing one another.

In use, elongated adjustment screw 4 is mounted to interior wall 16 by turning slotted screwhead 23 in a clock-wise direction with a screwdriver (not shown). Attachment screw 11 is mounted to interior door 17 by turning slotted screwhead 26 in a clockwise direction with a screwdriver (not shown). As shown in FIG. 1, when door 17 is opened, magnet 1 and magnet 8 contact magnetically securing door 17 in an open position.

While there has been shown and described a preferred embodiment of the magnetic doorstop of this invention, it is understood that changes in structure, materials, sizes, and shape can be made by those skilled in the art without departing from the invention. The invention is defined in the following claims.

I claim:

1. A device for securing an open door comprising:

a first section consisting of a magnet adapted with a first surface recess and a second surface recess interconnected by a centrally located aperture mounted circumferentially on an elongated adjustment screw and secured with a cylindrical retaining shim, and a second section consisting of a magnet adapted with a first surface recess and a second surface recess interconnected by a centrally located apertured mounted circumferentially on an attachment screw and secured with a cylindrical retaining shim, operable when one section is secured to the door and the other section is secured to interior wall to magnetically secure a door in the open position.

2. The device of claim 1 wherein: said first magnet means hating opposite first and second circumferential recess means.

3. The device of claim 2 wherein: said opposite first and second circumferential recess means are centrally located.

4. The device of claim 3 wherein: said opposite first and second centrally located circumferential recess means are interconnected by said aperture means.

5. The device of claim 1 wherein: said first magnet means is mounted circumferentially on elongated adjustment screw member.

6. The device of claim 1 wherein: said first retaining shim member having centrally located aperture means mounted circumferentially on said elongated adjustment screw member.

7. The device of claim 6 wherein: said first retaining shim member having centrally located aperture means mounted circumferentially on said elongated adjustment screw member operable to secure said first magnet means.

8. The device of claim 1 wherein: said elongated screw member having further adjustment means.

9. The device of claim 1 wherein: said second magnet means having opposite first and second circumferential recess means.

10. The device of claim 9 wherein: said opposite first and second circumferential recess means are centrally located.

11. The device of claim 10 wherein: said opposite first and second centrally located circumferential recess means are interconnected by said aperture means.

12. The device of claim 1 wherein: said second magnet means is mounted circumferentially on said attachment screw member.

13. The device of claim 1 wherein: said second retaining shim member having centrally located aperture means mounted circumferentially on said attachment screw member.

14. The device of claim 13 wherein: said second retaining shim member having centrally located aperture means mounted circumferentially on said attachment screw member operable to secure said second magnet means.

* * * * *